US009742093B2

(12) United States Patent
Genoa et al.

(10) Patent No.: US 9,742,093 B2
(45) Date of Patent: Aug. 22, 2017

(54) POWER BOX FOR A BACKPACK VACUUM

(71) Applicants: Scott Genoa, Merrick, NY (US); Mark Genoa, Dix Hills, NY (US)

(72) Inventors: Scott Genoa, Merrick, NY (US); Mark Genoa, Dix Hills, NY (US)

(73) Assignee: IMIG, INC., Farmingdale, NY (US)

( * ) Notice: Subject to any disclaimer, the term of this patent is extended or adjusted under 35 U.S.C. 154(b) by 0 days.

(21) Appl. No.: 15/249,006

(22) Filed: Aug. 26, 2016

(65) Prior Publication Data

US 2017/0062985 A1 Mar. 2, 2017

Related U.S. Application Data

(60) Provisional application No. 62/211,413, filed on Aug. 28, 2015.

(51) Int. Cl.

| | |
|---|---|
| ***H01R 13/44*** | (2006.01) |
| ***H01R 13/639*** | (2006.01) |
| ***H01R 27/02*** | (2006.01) |
| ***H01R 24/66*** | (2011.01) |
| *H01R 103/00* | (2006.01) |

(52) U.S. Cl.

CPC ..... *H01R 13/44* (2013.01); *H01R 13/639* (2013.01); *H01R 24/66* (2013.01); *H01R 27/02* (2013.01); *H01R 2103/00* (2013.01)

(58) Field of Classification Search

CPC ..... H01R 13/44

See application file for complete search history.

(56) References Cited

U.S. PATENT DOCUMENTS

| | | | | |
|---|---|---|---|---|
| 4,422,702 A * | 12/1983 | Nordeen | H01R 13/005 439/191 |
| 6,608,466 B2 * | 8/2003 | Riley | A47L 9/2868 15/344 |
| 2008/0189899 A1 * | 8/2008 | Beers | A47L 9/20 15/319 |
| 2009/0183336 A1 * | 7/2009 | Kunz | A47L 7/0095 15/339 |

* cited by examiner

*Primary Examiner* — James Harvey

(74) *Attorney, Agent, or Firm* — Law Office of Gerard F. Dunne; Gerard F. Dunne

(57) ABSTRACT

A power box adapted for use with a vacuum cleaning unit adapted to be carried on the back of a user, comprises an external housing including a power outlet recessed therein, the recessed power outlet further comprising a male power attachment, wherein the power box further comprises structures for receiving a power nozzle adapted for use with the vacuum cleaning unit.

2 Claims, 1 Drawing Sheet

POWER BOX FOR A BACKPACK VACUUM

RELATED APPLICATION

This application claims the benefit of U.S. Provisional Application No. 62/211,413 filed on Aug. 28, 2015.

FIELD OF THE INVENTION

The present invention relates to specific improvements in a power box for a backpack vacuum cleaning unit. In particular, the power box for a backpack vacuum can be worn by the user in an easy to access position, such as on a waist belt, thereby making access of the vacuum controls easier during the operation of the backpack vacuum.

SUMMARY OF THE INVENTION

The present invention is for the power box portion of a multi-piece vacuum, generally a backpack vacuum. In particular the present invention discloses a self-contained power box for providing the power to the backpack vacuum, and an optional power nozzle extension.

As shown in the drawings and described in detail below, according to the present invention a power box is provided with a recessed 3-prong male receiving outlet, a recessed female receptacle for an optional power nozzle hookup, and an on-off switch for controlling the power to the backpack vacuum.

DETAILED DESCRIPTION OF THE INVENTION WITH REFERENCE TO THE DRAWINGS

Figure 1:
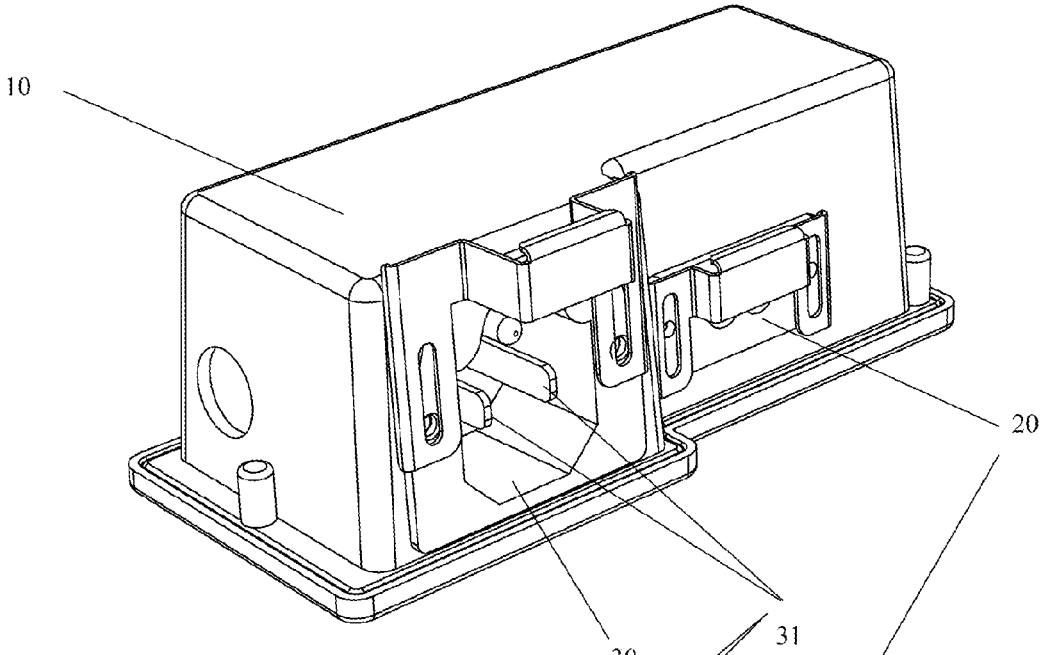
FIG. 1—Is a perspective view of the power box of the present invention.
Figure 2:
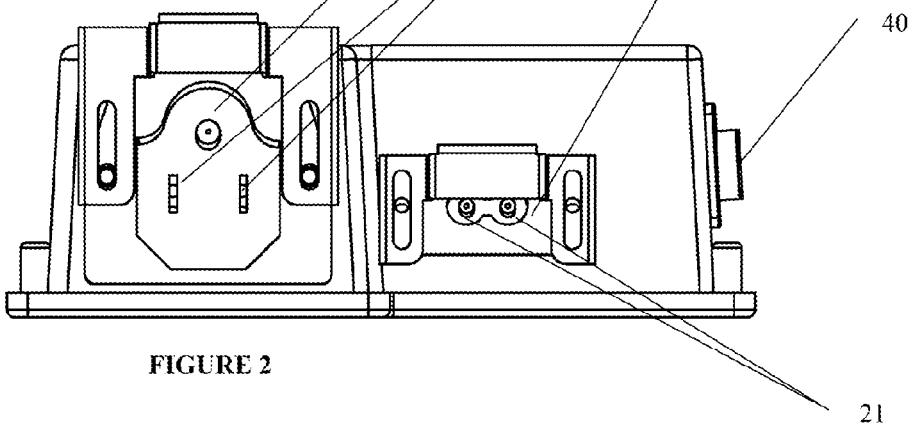
FIG. 2—Is an elevational view of the power box of the present invention

As shown in FIGS. 1 and 2, a vacuum power box (10) comprises a recessed power outlet (30) and recessed power nozzle hookup (20). The power outlet (30) comprising a male 3-prong attachment (31); and the power nozzle hookup (20) comprises twin female receptacles (21) for attaching an optional power nozzle.

In a typical backpack vacuum, a small power box is provided, that generally is fitted at or near the waist of the user, when the backpack vacuum is being worn for use. The vacuum portion is a backpack, and difficult to access, and thus a control box is generally provided for easy access to the controls.

The present invention maximizes the efficiency of the control box, by providing a multi-functional power box, with easy access to controls, adaptability, and minimal permanently attached wires. Further, the power connections on the power box (30 and 20) are recessed to allow for greater security, and reduce a user's need to worry about disconnecting or otherwise interfering with the wires while operating the vacuum. A shield is also provided at the top of each recessed connection, providing further security.

Any 3-prong extension cord can be used with the present invention, allowing versatile use in any setting, where any length chord may be needed. In some setting a very long cord (25-50 ft, and up) may be needed, and in others a cord that is only a few feet long is needed. The shielded and recessed cavity allows a secure hookup, that will not come undone easily while operating the machine, that is versatile to fit the need of whatever the setting requires.

Most backpack vacuum also come with an optional hookup for a power nozzle. The power nozzle allows backpack to be more versatile and attach a variety of extenders and attachments, which can act more like a standard, multi-function upright or canister vacuum wand. Similar to the above, the shielded and recessed cavity allows a secure hookup, that will not come undone easily while operating the machine, and allows for quick easy access and adaptation of the backpack for a variety of settings.

The power box contains a universal on/off switch (40) to control the power to the power box, and in turn the entire backpack vacuum.

What is claimed is:

1. A power box adapted for use with a vacuum cleaning unit adapted to be carried on the back of a user, said power box structurally arranged so as to be worn near the user's waist and comprising an external housing including a power outlet recessed therein, and said recessed power outlet further comprising a male power attachment within said recess; said power box further comprising structures for receiving a power nozzle adapted for use with said vacuum cleaning unit, said structures being recessed within said power box housing, said power box further comprising an on/off power switch and integrates said power outlet and the recessed structures for receiving said power nozzle of the vacuum cleaning unit adapted to be carried on the back of the user.

2. The power box of claim 1, said power box housing further comprising a shield portion on at least one side of said recessed power outlet, wherein said shield portion is at least semi-rigid and projects outward from the power box housing, said recessed structures for receiving said power nozzle further comprising twin female receptacles within said recess, said receptacles adapted for attaching an optional power nozzle; and said power box housing further comprising a shield portion on at least one side of said recessed structures for said power nozzle, wherein said shield portion is at least semi-rigid and projects outward from said power box housing.

* * * * *